US005194102A

United States Patent [19]

Wyss

[11] Patent Number: 5,194,102

[45] Date of Patent: Mar. 16, 1993

[54] METHOD FOR INCREASING THE STRENGTH OF ALUMINUM ALLOY PRODUCTS THROUGH WARM WORKING

[75] Inventor: Rebecca K. Wyss, Pittsburgh, Pa.

[73] Assignee: Aluminum Company of America, Pittsburgh, Pa.

[21] Appl. No.: 718,392

[22] Filed: Jun. 20, 1991

[51] Int. Cl.[5] ..... C22F 1/04

[52] U.S. Cl. ..... 148/695; 148/696; 148/697; 148/698; 148/699; 148/416; 148/417; 148/437; 148/438; 148/439

[58] Field of Search ..... 148/11.5 A, 12.7 A, 148/159, 416, 417, 418, 437, 438, 439, 695, 696, 697, 698, 699; 420/528, 529

[56] References Cited

U.S. PATENT DOCUMENTS

| | | | |
|---|---|---|---|
| 3,794,528 | 2/1974 | Rosales et al. | 148/12.7 R |
| 4,092,181 | 5/1978 | Paton et al. | 148/12.7 A |
| 4,222,797 | 9/1980 | Hamilton et al. | 148/12.7 A |
| 4,358,324 | 11/1982 | Mahoney et al. | 148/12.7 A |
| 4,596,609 | 6/1986 | Rennhack | 148/12.7 A |

OTHER PUBLICATIONS

Sommer, Patton and Folgner, "Effects of Thermomechanical Treatments on Aluminum Alloys", AFML--TR-72-5 (Feb. 1972).

Paton and Sommer, "Influence of Thermomechanical Processing Treatments on Properties of Aluminum Alloys", Paper 21, pp. 101-108 (1973).

Thompson, et al., "Program to Improve the Fracture Toughness and Fatigue Resistance of Aluminum Sheet and Plate for Aircraft Applications", AFML-7R-7-3-247 vol. I, (Sep. 1973).

Thompson, et al., "Thermomechanical Aging of Aluminum Alloys", *Aluminum*, vol. 50, Part I, p. 647, Part II, p. 719 (1974).

Kumar, et al., "Electron Microscopic Studies of Thermomechanically Aged 2218 Aluminum Alloy", Bull. Mater. Sci. vol. 10, No. 3, pp. 217-222 (May 1988).

Singh, et al., "Influence of Thermomechanical Aging on Tensile Strength Properties of 2014 Aluminum Alloy", Journal of Materials Science 25, 3894-3900 (1990).

*Primary Examiner*—R. Dean
*Assistant Examiner*—Robert R. Koehler
*Attorney, Agent, or Firm*—Arnold B. Silverman; Michael J. Kline; Gary P. Topolosky

[57] ABSTRACT

A method of improving strength in aluminum alloys. The method involves solution heat treating an aluminum alloy product, quenching the alloy product, warm working the alloy product without a pre-aging step, and aging the alloy product at 250°-400° F. (121°-204° C.). The method may be used on forgings, to impart T8-type hardness to alloys that previously could only obtain such hardness levels in non-forging applications, such as by using stretch/cold working techniques.

23 Claims, 6 Drawing Sheets

METHOD FOR INCREASING THE STRENGTH OF ALUMINUM ALLOY PRODUCTS THROUGH WARM WORKING

FIELD OF THE INVENTION

The present invention relates to a method of increasing the strength of aluminum alloy products. Particularly, the method involves using thermomechanical processing of age-hardenable aluminum alloys, to yield products of improved strength.

BACKGROUND OF THE INVENTION

In 2XXX aluminum alloys, improved strength is achievable by cold working the alloy after solution heat treatment and prior to aging. This promotes greater nucleation and refinement of the $\theta'$ precipitates in Al-Cu alloys, S' precipitates in Al-Cu-Mg alloys and $T_1$ precipitates in lithium-containing Al-Cu alloys. These precipitates are believed to be responsible for imparting increased strength to the finished product.

Sheet, plate or extruded 2XXX alloy product forms can be stretched or cold rolled prior to aging to achieve the optimum distributions of $\theta'$, S' and/or $T_1$ precipitation, depending upon the alloy, thereby imparting improved strength to the alloy. Products in this condition have achieved what is known in the art as a "T8" temper. However, it is quite difficult to uniformly cold work a forging through its entire thickness, in great part because such forgings typically are of non-uniform thickness and/or have a shape that does not lend itself to cold working Fabrication of an object of complex configuration from an aluminum alloy is typically achieved by closed-die forging of a billet of the alloy to produce a near-net-shape, which then requires only minimal machine finishing to achieve a final shape. The forging process permits control of metal flow, and thereby permits control of the formation of metallurgical microstructures in localized areas so that directional properties of the crystal structure of the alloy can be made to conform to directional requirements of the particular end use application of the object being fabricated In the prior art, forging procedures for aluminum alloys were generally formulated primarily to achieve specific geometrical configurations, and were not generally designed for maximum efficiency in process scheduling or for obtaining optimum mechanical properties in the objects being fabricated. In the prior art, a forging schedule for an aluminum alloy typically included multiple forging sequences, an intermediate reheating stage, a sizing or coining operation (depending upon the size and complexity of the object being fabricated), and a final heat-treatment sequence for thermal strengthening of the object.

Forging of an aluminum alloy is conventionally performed in a die heated in the temperature range of 690° F. to 880° F. (366°-471° C.) range. If the forged alloy is of the precipitation-hardenable type such as, for example, an aluminum alloy of the 2000, 6000 or 7000 series (also known as 2XXX, 6XXX and 7XXX, respectively) as described in standard texts such as the *Alcoa Aluminum Handbook*, Second Edition, Aluminum Company of America, Pittsburgh, Pa. (1962), the final heat-treatment sequence conventionally requires solution heat treatment, quenching and aging of the forged object at a temperature in the 250° F. to 400° F. (121°-204° C.) range for a relatively long period of time, which typically may be from 8 to 36 hours.

Various techniques have been employed to improve the strength of 2XXX and other aluminum alloys. One study evaluated and reported on properties achieved by thermomechanically processing 2024 alloy and suggested an optimal result was achieved through the steps of solution heat treating, stress relieving by stretching and room temperature aging to the T3 temper, warm working 5-15% at 375° F. (191° C.) and post aging at 375° F. (191° C.). See Sommer, Paton and Folgner, "Effects of Thermomechanical Treatments on Aluminum Alloys," AFML-TR-72-5 (February 1972). See also Paton and Sommer, "Influence of Thermomechanical Processing Treatments on Properties of Aluminum Alloys," Paper 21, Proceedings of the 3rd International Conference on Strength of Metals and Alloys, p. 101-108, Cambridge, England (1973). Others, however, were unable to reproduce these results. See Thompson, et al., "Program to Improve the Fracture Toughness and Fatigue Resistance of Aluminum Sheet and Plate for Aircraft Applications" AFML-TR-73-247, Vol. I (September 1973). See also, Thompson, et al., "Thermomechanical Aging of Aluminum Alloys," *Aluminum*, Vol. 50, Part I, p. 647; Part II, p. 719 (1974).

Others have used thermomechanical processing in an effort to improve the strength of forged aluminum alloy products. U.S. Pat. No. 4,596,609 discloses a method in which an age-hardenable aluminum alloy is solution heat treated, pre-aged at a temperature below the solution heat treatment temperature for about 0.5-1.5 hours, and worked. See also Kumar, et. al., "Electron Microscopic Studies of Thermomechanically Aged 221B Aluminum Alloy," Bull. Mater. Sci., Vol. 10, No. 3, p. 217-222 (May, 1988) and Singh, et. al., "Influence of Thermomechanical Aging on Tensile Strength Properties of 2014 Aluminum Alloy," Journal of Material Science 25, p. 3894-3900 (1990).

A significant advance in the art could be realized if T8-type strength properties could be imparted to alloys which are presently not able to achieve such strength properties. More specifically, an advance in the art could be realized if T8-type strength properties could be imparted to aluminum alloys such as 2XXX and 8XXX alloys in forgings.

SUMMARY OF THE INVENTION

According to the present invention a method of improving the hardness of an aluminum alloy product is provided, the method comprising providing an age-hardenable aluminum alloy product, solution heat treating the alloy product, quenching the alloy product, warm working the alloy product by deforming the alloy product by up to about 50% at one or more deformation steps and one or more deformation temperatures between about 300°-600° F. (149°-316° C.) and aging the alloy product at about 250°-400° F. (121°-204° C.). The alloy product may optionally be given an intermediate deformation step prior to solution heat treating, then deformed to the final shape by warm working following the quench.

In another preferred embodiment of the invention, the aluminum alloy product is an age-hardenable alloy forging which is imparted with T8-type properties using the method of the invention.

Accordingly, it is an object of the invention to provide a method for improving the hardness of an aluminum alloy product.

It is another object of the invention to impart T8-type hardness to aluminum alloy forgings.

It is another object of the invention to produce high strength 2XXX aluminum alloys by warm working rather than cold working prior to aging.

It is still another object of the invention to provide a method of imparting increased strength to aluminum alloys, which method yields greater strength properties than those achieved by present T6 tempers.

BRIEF DESCRIPTION OF THE DRAWINGS

A full understanding of the invention can be appreciated from the following description of the preferred embodiments, when read in conjunction with the accompanying drawings wherein FIGS. 1 through 5 refer to an aluminum-copper alloy, and FIG. 6 an Al-Li alloy; and "CW" means "cold worked", "WW" means "warm worked", "NA" mean "natural aged" and.

DESCRIPTION OF THE PREFERRED EMBODIMENTS

Figure 1:
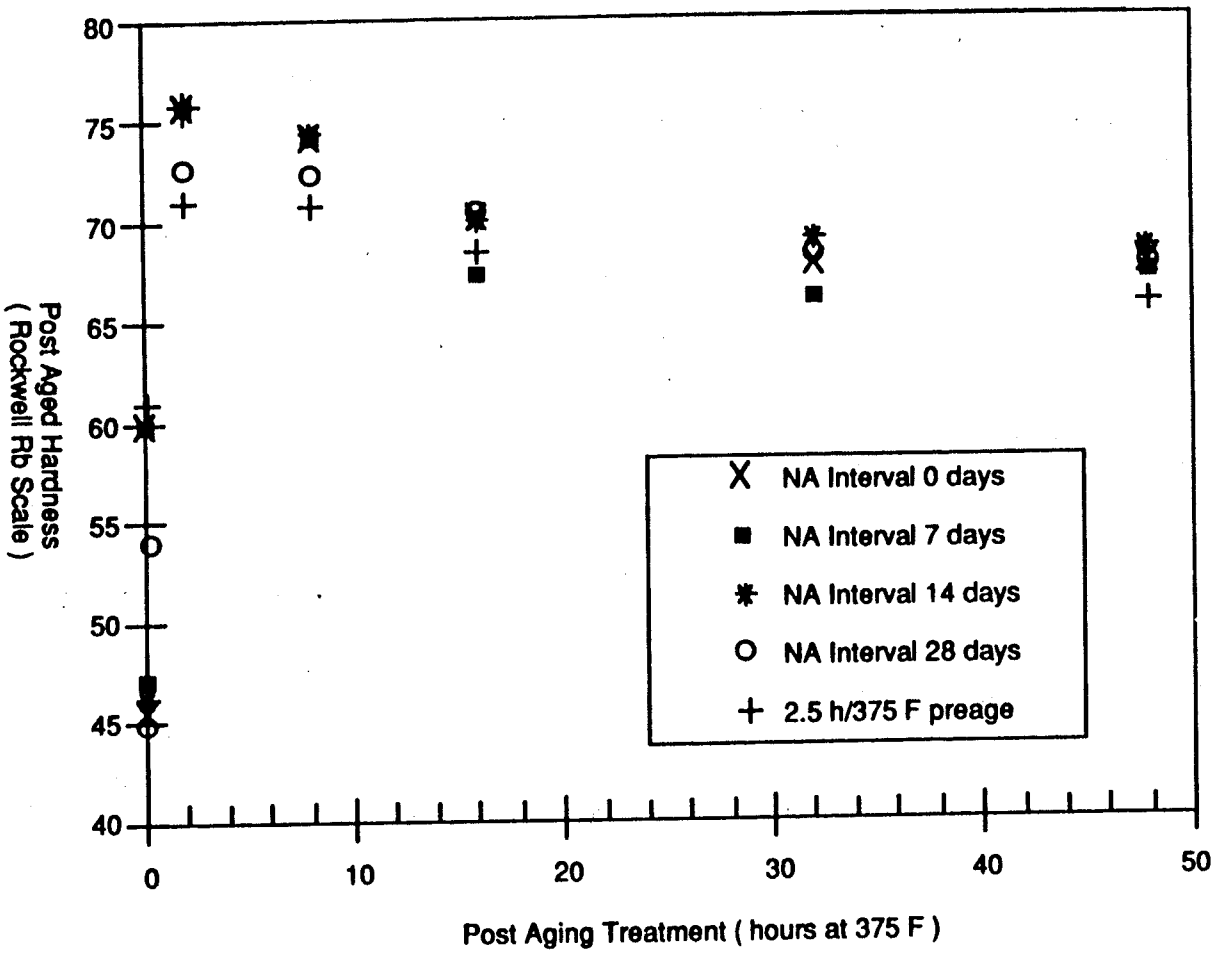
FIG. 1 illustrates graphically the effect of a preage at 375° F. (191° C.) and natural aging on post-aged hardness, where the preage and natural age occurs after solution heat treating and before warm working.

As used herein, the term "aluminum alloy product" is intended to mean, unless noted otherwise, an alloy, the predominant component of which is aluminum, whether cast, forged, wrought, unwrought, and whether in extrusion, billet, sheet, ingot or finished form.

In the conventional process for achieving T8 type hardness levels in aluminum alloys, the aluminum alloy product is deformed at an elevated temperature, solution heat treated, quenched, cold worked (stretched) and aged at elevated temperature to T8 strength. Such processes do not lend well to forgings, which as a practical matter cannot be stretched or uniformly cold-worked throughout their cross-sectioned thickness.

As used herein, the term "T8" means a temper designation for an aluminum alloy product which is solution heat treated, cold worked and artificially aged. This designation normally applies to products that are cold worked to improve strength, or in which the effects of cold work in flattening or straightening is recognized in mechanical property limits. As used herein, the term "T6" means a temper designation for an aluminum alloy product which is solution heat treated and then artificially aged. This designation normally applies to alloy products that are not cold worked after solution heat treatment, or in which the effect of cold work in flattening or straightening may not be recognized in mechanical property limits.

In the novel process of one preferred embodiment of the present invention, a portion of the total desired deformation is preferably carried out on an aluminum alloy product, deforming the aluminum alloy product to an intermediate shape at an elevated deformation temperature, about 400°-850° F. (204°-454° C.), after which the intermediate shaped aluminum alloy product is solution heat treated, quenched and then warm worked to achieve final deformation at a warm working temperature, preferably less than about 575° F. (302° C.), followed by aging. This process permits attainment of T8 type hardness levels even in forgings, without cold working.

The thermomechanical forging process of the present invention has been practiced on different aluminum alloys, and has demonstrated the ability to impart improved strength properties to these alloys.

The invention differs in a number of ways from prior work, such as Somer, et al., in that, for example, the present invention does not require stress relieval stretching at room temperature or natural aging prior to warm working. Additionally, the invention differs from prior work in that it involves warm working, rather than cold working, of aluminum 2XXX alloys, prior to aging and does not require a pre-aging step prior to warm working.

In practicing the invention, there is first provided an age-hardenable aluminum alloy product. "Age-hardenable" as used herein refers to alloys which harden upon aging, typically by forming precipitates which impede dislocation motion. As used herein, "precipitation hardenable" is the equivalent to "age-hardenable."

There are a number of age-hardenable aluminum alloy products which can benefit from the process of the invention in terms of improved strength properties. For example, those alloys of the type having precipitation phases $$\text{Al} \rightarrow \text{GP zones} \rightarrow \theta'' \rightarrow \theta'$$

have proven capable of being imparted with improved strength properties when treated according to the process of the invention. Other aluminum alloys can also benefit from the method of the invention. Such alloys include, by way of example but not limitation, 2014, 2024, 2048, 2124, 2324, 2090, 2091, 2219, 2319, 2419, 2519, 8090, 8091 and others as registered with the Aluminum Association, Inc. The registered compositions of these alloys are incorporated by reference herein. For more information concerning these alloys, their manufacture and remelt compositions, see ASM Metals Handbook, Vol. 2, 10th edition.

Aluminum-lithuim, aluminum-copper-magnesium and aluminum-lithuim-magnesium-copper alloys may benefit from the method of the present invention. Such alloys typically comprise, by weight, about 0.2-5% Li, 0-6% Mg, 0.2-5% Cu, 0-2% Mn, maximum 0.5% Fe, maximum 0.5% Si, 0-12% Zn, 0-0.2% Ti and 0-1% Zr. Such alloys are known in the art, and described in U.S. Pat. Nos. 4,806,174; 4,961,792; 4,844,750; 4,797,165; 4,648,913; 4,921,548 and 4,897,126, incorporated by reference herein.

Aluminum-copper alloys such as 2219 typically comprise, by weight, about 5.3–6.8% Cu, up to about 0.25% Si, up to about 0.30% Fe, about 0.10–0.50% Mn, about 0–0.4% Mg, up to about 0.10% Zn, about 0.02–0.10% Ti, about 0.05–0.15% V, about 0.10–0.25% Zr, balance Al.

The invention has proven especially useful with respect to the 2XXX alloys, such as aluminum-copper, for example, alloy 2219 and aluminum-lithium, such 2090 and 8090 and others, and for aluminum-copper-magnesium and aluminum-lithium-magnesium-copper alloys as well. Such alloys have, until now, typically achieved T8-properties from solution heat treating, quenching, stretching or some cold work not practical with closed-die forgings, and finally, aging. The process of the present invention results in T8-properties even in forgings, using a warm working step following the quench and prior to final aging.

In practicing the method of the invention, the age-hardenable alloy selected, which may or may not have received an intermediate deformation step, is solution heat treated according to known methods. Generally, solution heat treating involves heating the work piece or alloy product to an elevated temperature, typically about 750°–1060° F. (399°–571° C.) which elevated temperature favors dissolving the soluble particles in the alloy in the solid state. The time for solution heat treating varies with the alloy used, the size of the precipitates to be dissolved and the size of the workpiece, but times of about 0.5 to 1 hour or more are typical.

After the alloy product has been solution heat treated, it is rapidly quenched, using known methods, such as water sprays or immersion in a water or water-polymer quench bath. Whatever method of quench is employed, the objective is to cool rapidly enough to avoid nucleation of precipitates during the quench which deplete the solute available to form the optimum distribution of precipitates during the subsequent aging. The rate of cooling is affected by a number of factors, such as workpiece thickness, water (or other coolant) temperature, flow rate and/or volume, temperature of the hot alloy product, etc. If the quench does not occur rapidly enough, an undesirable result from the standpoint of improving strength properties may occur.

Following quenching, the alloy product is warm worked, preferably at a temperature below the typical hot working temperature of the particular alloy, generally about 400°–850° F. (204°–454° C.).

I have surprisingly found that the warm working step may be carried out without any preage treatment following solution heat treating. In fact, I have found that even natural aging (aging at room temperature) or even artificial aging at 375° F. (191° C.) the alloy product between the solution heat treating step and the warm working step has no effect on post aged hardness, as demonstrated in FIG. 1. This represents a departure from prior art methods requiring either natural age or a preaging step at artificial aging temperatures of about 200°–400° F. (93° C.–204° C.) following solution heat treating. See U.S. Pat. No. 4,596,609. As illustrated in FIG. 1, natural aging has no effect on post aged hardness, whether the natural age (NA) is for 0, 7, 14 or 28 days. The aluminum alloy product samples used in obtaining the data shown in FIG. 1 were solution heat treated, preaged, and warm worked to 10% deformation at 375° F. (191° C.) prior to past aging.

The warm working technique employed may vary depending upon the type of alloy being worked, but may be accomplished using known warm working methods, such as press-forging or hammer-forging. Such working can also be performed using conventional tool-steel dies.

The amount of deformation employed in the warm working step may also vary from one alloy to the next, but a range of about 5–50% deformation has proven to yield improvement in post-aged alloy strength.

The warm working step need not be carried out at a single deformation temperature, and may beneficially be carried out at a range of temperatures within the workpiece and in more than one deformation step, each deformation step having its own deformation temperature. This is especially true in the case of forgings having varying thickness, in which case the temperature of the alloy product being warm worked may vary from point to point within the workpiece.

The warm working step is preferably carried out at a temperature of about 300°–600° F. (149°–316° C.), depending upon the alloy being worked and the method of warm working. Target warm working temperatures are preferably low enough to allow for adiabatic heating during warm working, which heating will depend on the total amount of strain and strain rate placed on the work piece.

The strain rates applied during the warm working step are preferably on the order of about 0.1 to 1.0 $sec^{-1}$. These rates will vary depending upon the method of deformation. For example, as a practical matter, a maximum strain rate of about 2.0 $sec^{-1}$ may be achieved using hydraulic presses. Mechanical presses and hammers are capable of achieving strain rates of up to about 10 $sec^{-1}$. More preferably, the strain rate used in practicing the present invention is about 0.01 to 1.5 $sec^{-1}$, and most preferably is about 1.0 to 1.5 $sec^{-1}$.

Following warm working, the alloy product is aged, preferably at a temperature of about 250°–400° F. (121°–204° C.) for a period of time sufficient to complete the precipitation reaction or reactions, or achieve peak hardness. The aging step is preferably carried out for a time sufficient to achieve peak hardness, generally about ten minutes to two hours or more.

In a method of the invention for forging finished products, a forging blank comprising an age-hardenable alloy is provided and the blank is given an intermediate deformation, being worked under pressure with appropriate dies into a workpiece sized larger than the desired finished product, but preferably approaching the size and shape of the finished product. The blank is then solution heat treated and quenched, and is warm worked by reduction with appropriate dies to the shape of the end product. The workpiece is reduced, after solution heat treating and quenching and prior to aging, to a final end product shape, by imparting up to about 50% total deformation at one or more temperatures between about 400°–575° F. (204°–302° C.) with appropriate dies. The workpiece is then aged as previously discussed.

EXAMPLES

Example 1

A 14-inch round ingot of preheated 2219 alloy was used for this example. The remelt chemical composition was, by weight, 6.02% Cu, 0.06% Si, 0.19% Fe, 0.28% Mn, 0.02% Zn, 0.05% Ti, 0.09% V, 0.13% Zr, balance Al. Samples for axisymmetric deformation were machined from the center of the ingot with no samples being taken from the outer 2 inches of the ingot.

All samples were solution heat treated and cold water quenched. Samples were stored in a freezer between all deforming and heat treating operations.

Initial microstructures were generated by solution heat treating and then preaging prior to warm working. The preage treatments were as follows: GP zones were achieved by naturally aging the aluminum alloy product for four weeks, and $\theta''$ precipitates were achieved by treating the aluminum alloy product for 2.5 hours at 375° F. (191° C.).

In addition, a subset of samples were studied to provide a baseline of expected T6 and T8 properties. Samples of the T6 conditions were not deformed prior to aging while samples of the T8 baseline condition were given two levels of cold work, 5 and 10%, prior to aging.

The range of total amount of strain studied was 5 to 50%. Two levels of strain rate, 0.1 and 1.0 sec,$^{-1}$ were selected to evaluate the effect of strain rate in the range typically used in the fabrication of forged parts.

A computer controlled servo-hydraulic compression testing machine was used for all deformations. For all warm working conditions, the samples reached the desired warm working temperature in 6–7 minutes. There was no soak prior to working. Following warm working, samples were quenched in cold water.

Rockwell Rb hardness was measured.

Figure 3:
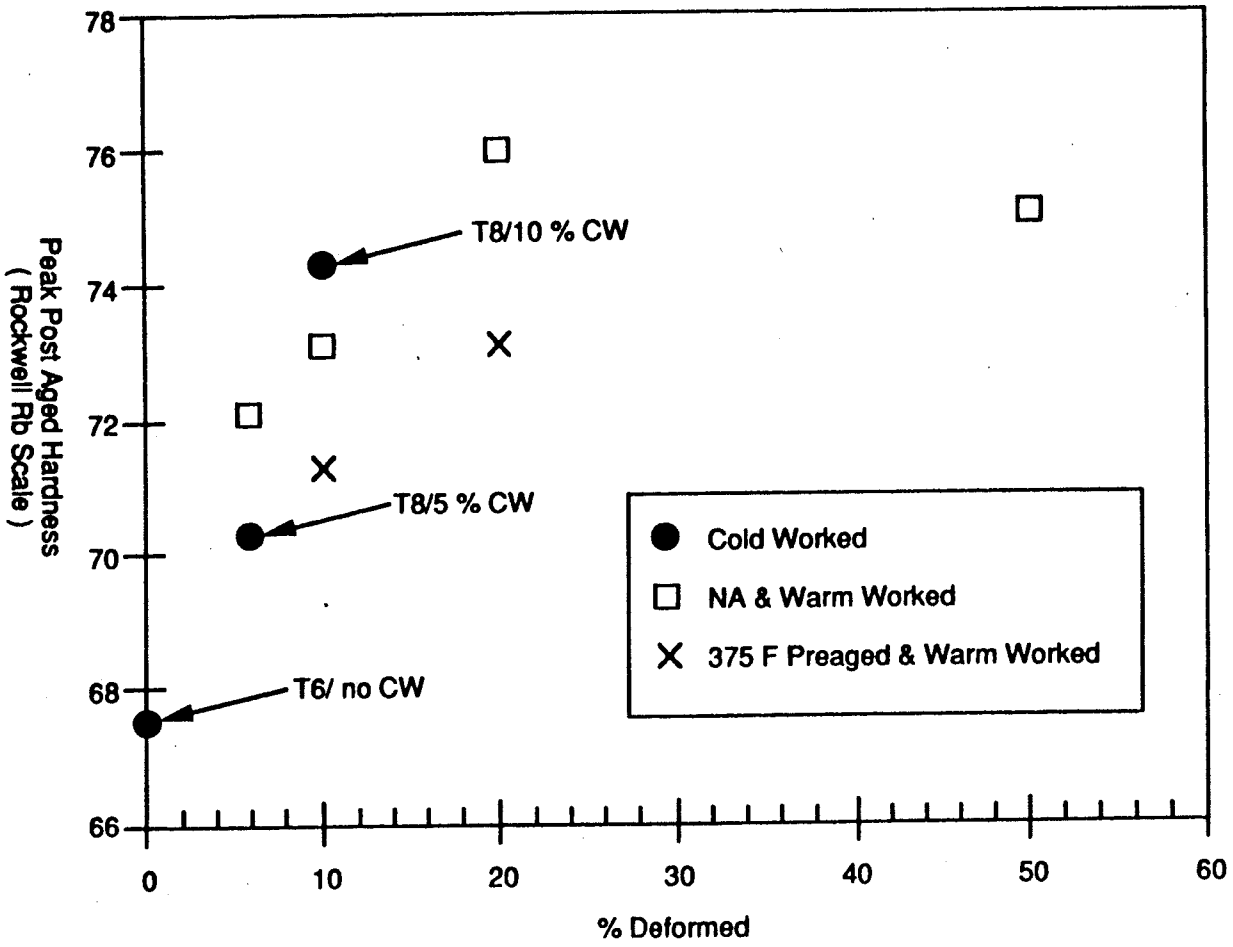
FIG. 3 is a graphical representation showing peak post aged hardness as a function of per cent deformation, demonstrating the favorable results of the warm working treatment of the present invention as compared with cold worked samples.

FIG. 3 compares the peak 375° F. (191° C.) post aged hardness of T6 and T8 samples with warm worked samples prepared according to the method of the invention. All deformed samples plotted in FIG. 3 were given a 0.1 sec$^{-1}$ strain rate and warm working was done at 375° F. (191° C.). For samples initially natural aged, which contained GP zones, FIG. 3 shows 5–10% warm working according to the present invention produces higher hardnesses than the T6 or 5% cold worked T8 condition. When warm worked 20 and 50%, these samples had slightly higher peak hardnesses than the 10% cold worked T8 conditions. Warm worked samples initially preaged 2.5 hours at 375° F. (191° C.) to contain $\theta''$ precipitates generally have slightly lower peak hardnesses than the natural aged and warm worked samples initially having a GP zone structure.

The results indicate that the time required to attain peak hardness is dependent on the amount of warm work. For example, the post aging time producing peak hardness decreases with increasing warm deformation. Specifically, peak hardness for the 5% warm worked samples occurs at 8 hours, whereas; for the 10% to 50% warm worked samples, peak hardnesses occurred at 2 hours. However, since the aging curve is relatively flat near peak hardness, the range of hardness for the 5 to 50% warm worked samples decreases from approximately 5 units for a 2 hour post-aging treatment to less than 2 Rockwell Rb hardness units for post-aging times greater than 2 hours.

Estimates of tensile strength can be made for the samples to demonstrate that differences of approximately 4 Rb hardness units for the peak post aged warm worked condition corresponds to approximately 3 ksi spread in tensile strength. Moreover, the approximately 5 unit spread in hardness for a 2 hour post aging treatment corresponds to 4 ksi in tensile strength.

This calculation of strength can be further used to compare the properties of the peak post aged warm worked materials initially containing GP zones prepared according to the method of the present invention, to 2219 minimum and typical mechanical properties. This comparison is given in Table I. As shown, expected tensile strengths of alloys produced with the warm working step according to the present invention are as high, and in some cases higher, than T8 cold worked alloys.

TABLE I

Comparison of 2219 minimum and typical mechanical properties to predicted strengths of warm worked materials.

| | Ultimate Tensile Strength (KSI) |
|---|---|
| I. 2219-T6 DIE FORGINGS | |
| A. Minimum | |
| L | 58 |
| T | 56 |
| B. Typical | |
| L | 63 |
| T | 61 |
| II. 2219-T852 (3–6% permanent set cold (work) DIE FORGINGS: | |
| A. Minimum | |
| L | 62 |
| T | 60 |
| III. Predicted Peak Post Aged UTS for Samples in this Study* | |
| A. Controls | |
| T6 | 59.4 |
| 5% CW T8 | 61.6 |
| 10% CW T8 | 64.7 |
| B. Warm Worked at 375° F. −0.1 sec$^{-1}$ Strain Rate According to Present Invention | |
| 5% WW | 63.0 |
| 10% WW | 63.6 |
| 20% WW | 66.1 |
| 50% WW | 65.6 |

Figure 4:
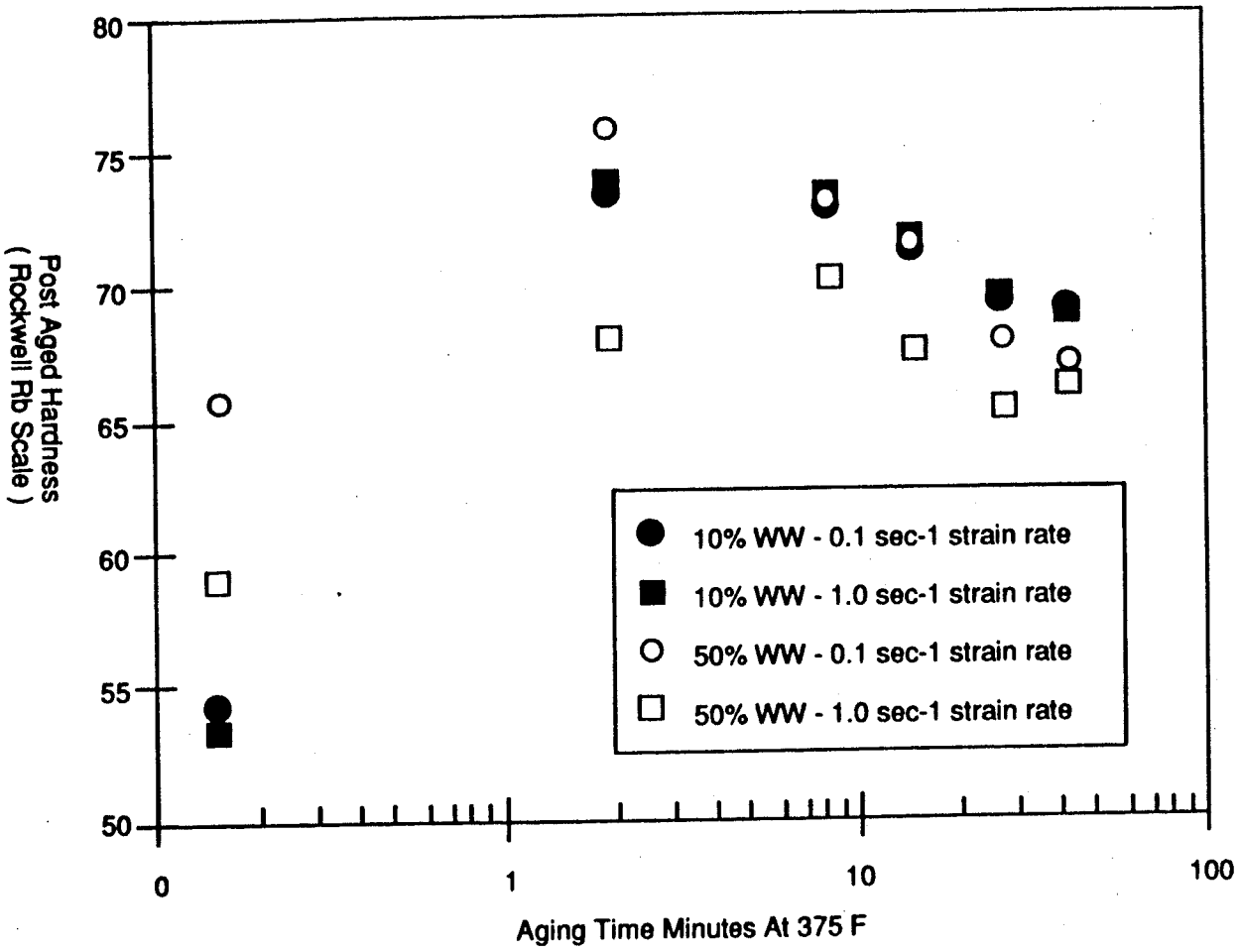
FIG. 4 is a graphical representation of the effect of strain rate on hardness, as a function of post aging time, for two different deformations, 10 and 50%.

*Post aged at 375° F.
L = Tested in longitudinal direction
T = Tested in long transverse direction The effect of strain rate on post aged hardness is shown in FIG. 4. The samples plotted in FIG. 4 were also warm worked at 375° F. (191° C.) after being natural aged to contain GP zones, and were post aged at 375° F. (191° C.). As illustrated in FIG. 4, for samples warm worked 10% according to the present invention, strain rate has no influence on the resulting post aged hardness. However, for the 50% warm worked samples, the sample deformed at the faster (1.0 sec$^{-1}$) strain rate developed a relatively lower peak hardness. This effect of strain rate is believed to be related to maximum deformation temperatures. For the 50% warm worked sample, a maximum deformation temperature of 493° F. (256° C.) was recorded for the sample deformed using the 1.0 sec$^{-1}$ strain rate.

These results suggest that the benefit associated with warm working according to the present invention is the enhanced strength which is relatively independent of amount of total strain. For forgings, this translates into a product with improved strength and more uniform property characteristics (e.g. strength) from skin to core. Ultimate tensile strengths of at least about 60 ksi can be achieved in such forgings.

EXAMPLE 2

The experimental procedure for Example 2 was the same as that discussed in detail in Example 1.

Specimens from the same 2219 billet of Example 1 were used. The specimens were solution heat treated and cold water quenched. Although not necessary to the present invention, specimens were natural aged for 4 weeks at room temperature to contain GP zones prior to warm working. Specimens were stored in the freezer between all deforming and heat treating operations.

Warm working was done using a servo hydraulic testing machine. Strain and strain rate were constant during axisymmetric deformation and were set at 10% and 0.1 $sec^{-1}$, respectively. Target deformation temperatures of between 375° F. (191° C.) and 575° F. (302° C.) were specified.

Figure 2:
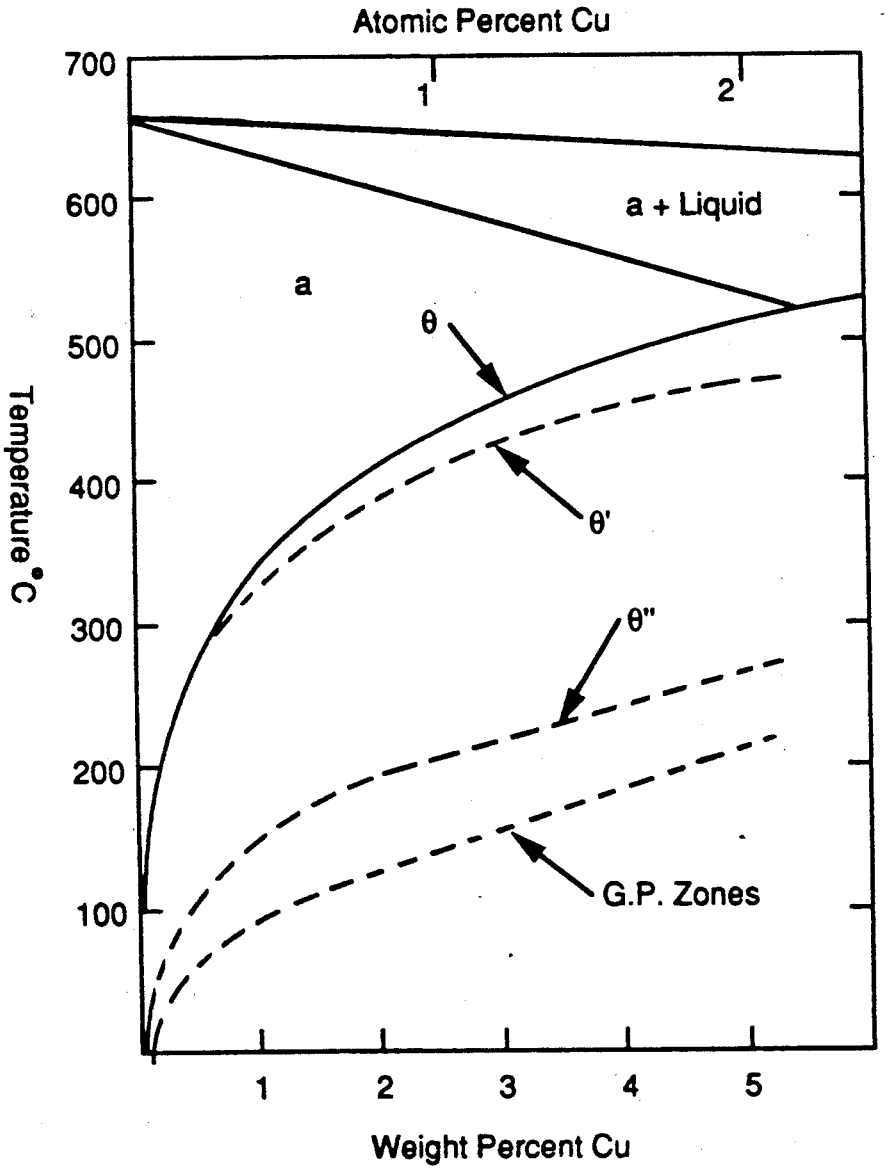
FIG. 2 is an Al-Cu phase diagram showing metastable solvus temperatures.

For perspective, the Al-Cu phase diagram with the metastable solvi is given in FIG. 2. For the alloy of this study, which contains 6.02 wt. % Cu, the $\theta''$ solvus temperature is approximately 534° F. (279° C.).

The results of this experiment established that the peak post aged hardness of the original material warm worked at 375° F. (191° C.) in Example 1 was reproduced by the other samples warm worked below the $\theta''$ solvus. The hardnesses of these samples are comparable to the hardness of specimens in the T8 temper.

Figure 5:
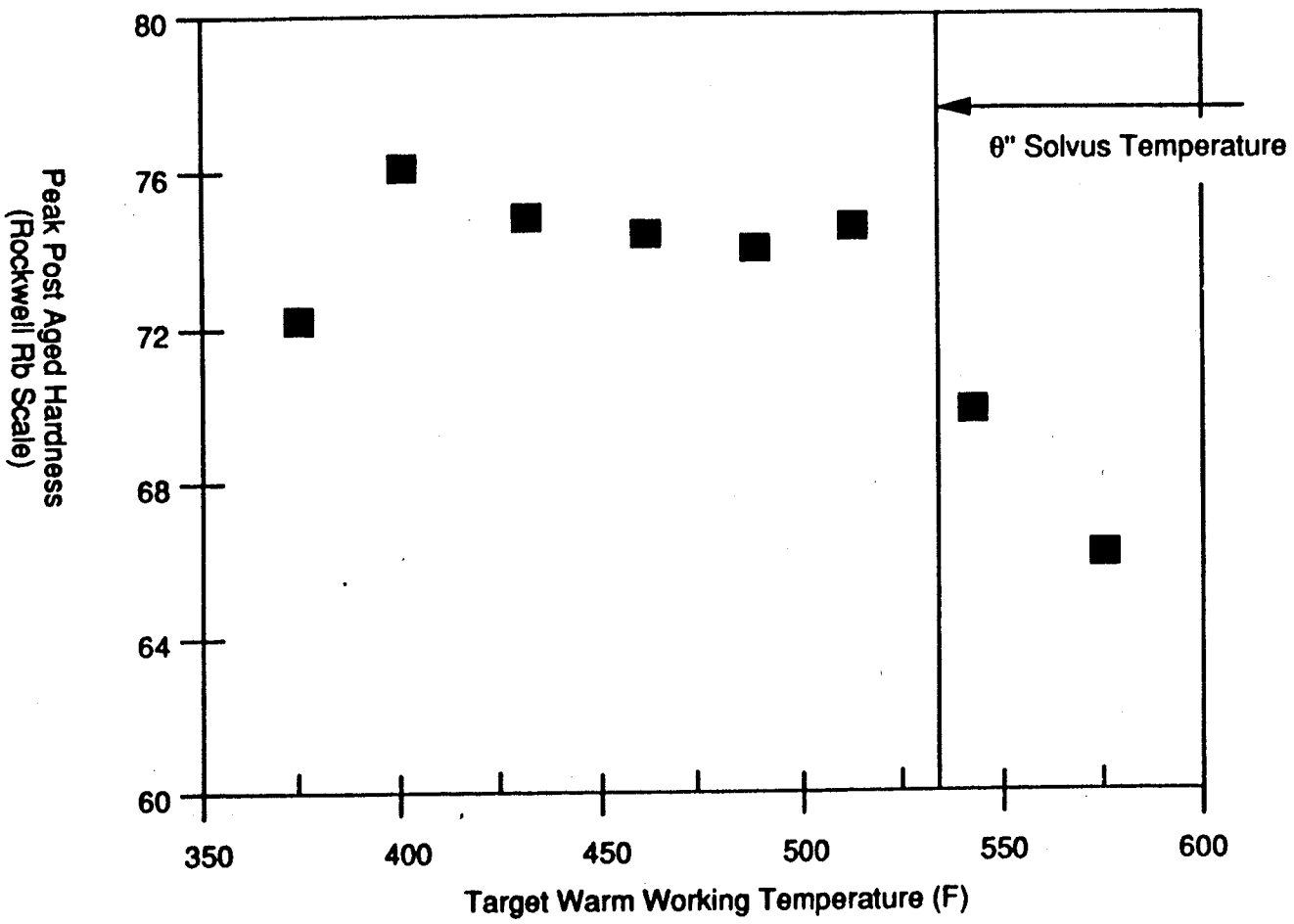
FIG. 5 is a graphical representation of the effect of warm working temperature on peak post aged hardness for warm worked materials produced according to the present invention.

FIG. 5 illustrates the relationship between peak post aged hardness and deformation or warm working temperature. For deformation at lower temperatures, the peak post aged hardnesses are similar. With deformation near or above the solvus temperature (or about 534° F. (279° C.) for alloy 2219), the peak post aged hardnesses decrease, as is readily apparent from FIG. 5.

For the materials warm worked at or below the solvus temperature, the aging time for peak hardness tends to increase from 2 to 8 hours as the warm working temperature approaches the solvus temperature.

Example 3

The method of the invention was practiced on an aluminum-lithium alloy having a remelt composition of about (by weight) 2.12% Li, 2.63% Cu, 0.33% Mg, 0.93% Zn, 0.40% Mn, 0.02% Zr, 0.07% Fe, 0.02% Ti, 0.06% Si and balance aluminum.

Two billets of the aluminum-lithium alloy were solution heat treated and cold water quenched. Although it was later discovered this step was not necessary (see FIG. 1) the quenched billets were natural aged for two weeks. One billet was deformed 10%, the other 50%, both at a 0.1 $sec^{-1}$ strain rate, using temperatures from 320° F. to 700° F. (160°-371° C.). The billets were post-aged at 325° F. (163° C.).

For comparison, T6 and T8 control materials were generated by solution heat treating identical billets of this alloy, followed by cold water quench and a two week natural age. The T6 control billet was not deformed, but aged at 325° F. (163° C.). The two T8 control billets were given a 5% and 10% cold work and post-aged at 325° F. (163° C.).

Figure 6:
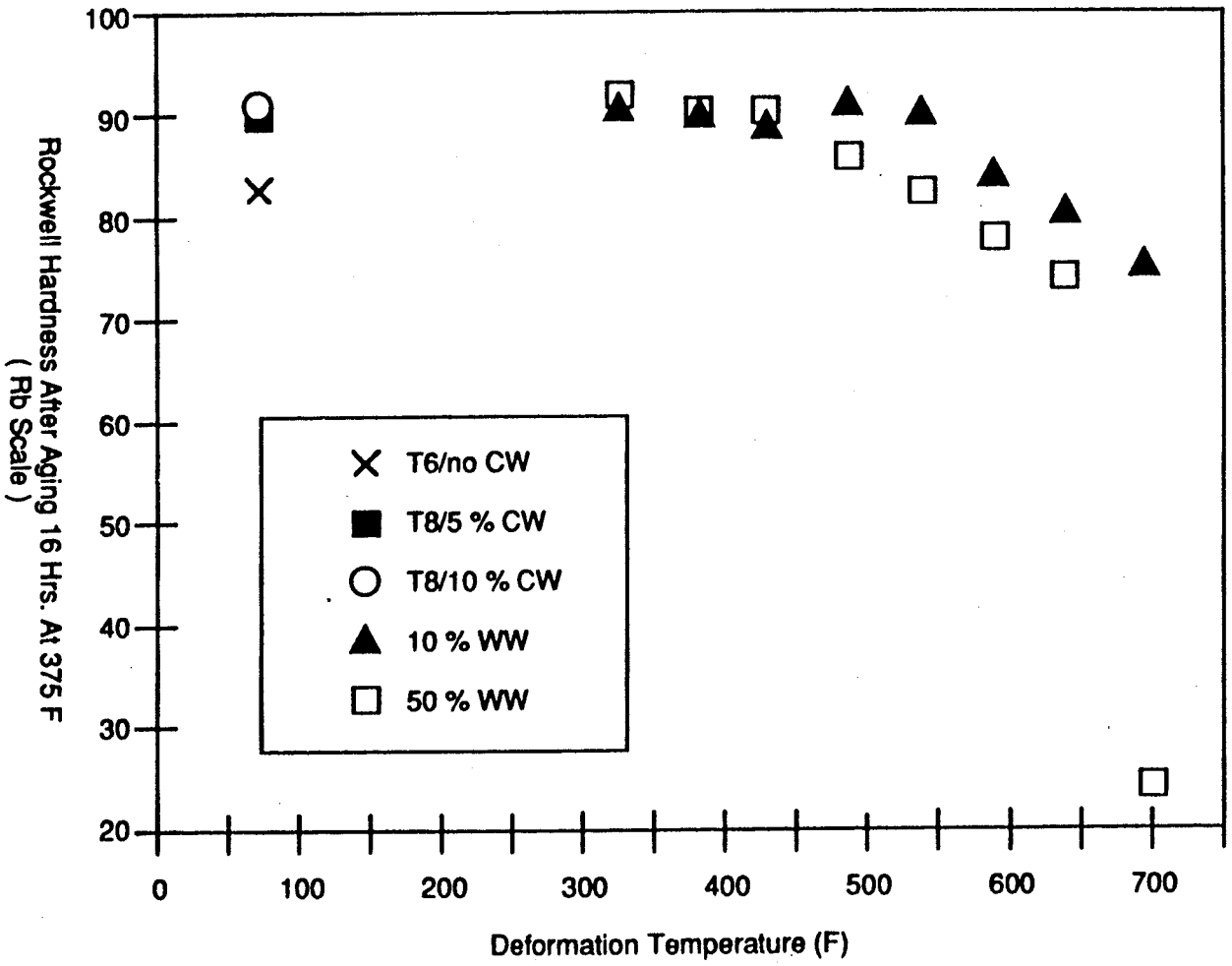
FIG. 6 is a graphical representation of hardness after post aging 16 hours at 325° F. (163° C.) versus deformation temperature for an Al-Li alloy at 10 and 50% warm working by the method of the present invention, compared with hardness of the same alloy in the T6 temper with no cold work and the same alloy in the T8 temper at 5 and 10% cold work.

The aging response of the control alloys and warm worked materials indicates no evidence of overaging even up to 48 hours (2880 minutes). After aging 16 hours the T8 and warm worked materials were near or at their maximum hardness while the T6 condition was still slightly underaged. As no definite peak exists, the 16-hour post aged hardness of the various materials was plotted in FIG. 6. As FIG. 6 shows, the post aged hardnesses of materials warm worked 10% at temperatures less than about 550° F. (288° C.) and 50% at temperatures less than about 450° F. (232° C) are similar to or slightly better than the T8 (5% and 10% cold worked) control materials and much greater than the T6 hardness.

The T6 control was reported to be fully recrystallized Therefore, some of the hardening measured in the warm worked materials is believed to be due to these conditions having a deformed, unrecrystallized grain structure. In addition, the Rockwell Rb scale tops out at 100. Therefore, some of the T8 and warm worked materials are approaching the end of this scale's measurement sensitivity.

As illustrated in FIG. 6, although there appears to be an interaction between the warm deformation amount and temperature, materials warm worked up to about 450° F. (232° C.) have similar hardnesses regardless of the deformation temperature or amount of total deformation, for example, between about 10% and 50%. Above about 450° F. the post aged hardness of the 50% deformed materials decreases. For material warm worked 10%, post aged hardness begins to drop off at temperatures above about 550° F. (288° C.).

The present invention has been described above in terms of particular alloys of aluminum, which are representative of age-hardenable systems. The particular examples described herein are merely illustrative of the invention, which is defined more generally by the following claims and their equivalents. While many objects and advantages of the invention have been set forth, it is understood that the invention is defined by the scope of the following claims, not by the objects and advantages. For example, though one advantage of the invention is its use in forgings, it will be immediately appreciated by those skilled in the art that the method of the invention may be practiced upon castings, and the claims, where not otherwise limited, are intended to embrace this and all other uses of the invention.

I claim:

1. A method for improving the strength of an age-hardenable aluminum alloy product, said method comprising the steps of:
   (a) solution heat treating the alloy product;
   (b) quenching the alloy product;
   (c) deforming the alloy product in one of more deformation steps by up to about 50% total deformation at one or more deformation temperatures between about 300° F. and 600° F.; and
   (d) aging the alloy product at one or more temperatures above said 250° F., wherein said method proceeds without preaging prior to said deforming step (c).

2. The method of claim 1, wherein the aluminum alloy product is deformed at a strain rate of up to about 10 $sec^{-1}$.

3. The method of claim 1 wherein the alloy product contains a main alloying component of copper or lithium.

4. The method of claim 3 wherein the alloy product is made from an alloy selected from the group consisting of 2014, 2024, 2048, 2124, 2324, 2090, 2091, 2219, 2319, 2419, 2519, 8090 and 8091 aluminum.

5. The method of claim 1 wherein the alloy product is deformed from about 2% to about 45% total deformation at one or more temperatures below about 450° F.

6. The method of claim 1 wherein the alloy product is deformed by up to about 15% total deformation at one or more temperatures above about 450° F.

7. The method of claim 1 wherein said aging step (d) proceeds until peak hardness is achieved in said alloy product.

8. The method of claim 7 wherein said alloy product is aged for at least about ten minutes at one or more temperatures below about 400° F.

9. The method of claim 1 which further includes partially deforming the alloy product prior to solution heat treating step (a).

10. A method for imparting T8-type strength levels to an age-hardenable aluminum alloy forging comprising:

(a) providing a forging of the alloy that has been solution heat treated and quenched;

(b) deforming the forging by about 2-50% total deformation at one or more elevated temperatures below the temperature at which metastable precipitates dissolve in said alloy; and (c) aging the deformed forging at one or more temperatures between about 250° F. and 400° F.

11. The method of claim 10 wherein the alloy is selected from the group consisting of: 2014, 2024, 2048, 2124, 2324, 2090, 2091, 2219, 2319, 2419, 2519, 8090 and 8091 aluminum.

12. In a method for forging finished product from an age-hardenable aluminum alloy which comprises: providing a forging blank; working the blank under pressure within at least one die to form a workpiece sized larger than the finished product; solution heat treating and quenching the workpiece; reducing the size of the workpiece to form the finished product; and aging the finished product, the improvement which comprises reducing the size of the workpiece after quenching and without predging by up to about 50% total deformation at one or more temperatures and in one or more deformation steps between about 300°-600° F. prior to aging.

13. The improvement of claim 12 wherein the aluminum alloy contains copper or lithium as a main alloying component.

14. The improvement of claim 13 wherein the finished product is made from an aluminum alloy selected from the group consisting of: 2024, 2124, 2324, 2090, 2091, 2219, 2319, 2419, 2519, 8090 and 8091 aluminum.

15. The improvement of claim 12 wherein the finished product is made from an aluminum alloy.

16. The improvement of claim 12 wherein the workpiece is deformed from about 2-45% total deformation at one or more temperatures below about 450° F.

17. The improvement of claim 12 wherein the workpiece is deformed by up to about 15% total deformation at one or more temperatures above about 450° F.

18. An aluminum alloy forging which comprises, by weight, about 5.3-6.8% Cu, up to about 0.25% Si, up to about 0.30% Fe, about 0.10-0.50% Mn, about 0-0.4% Mg, up to about 0.10-0.25% Zr, balance Al, said forgoing having improved strength levels from having been: solution heat treated; quenched; deformed by about 2% or more at one or more elevated temperatures below about 575° F. without preaging; and aged for at least about ten minutes at one or more temperatures between about 300°-400° F.

19. The forging of claim 18 which has been deformed by up to about 50% total deformation using a strain rate of about 0.1-1.5 $sec^{-1}$.

20. The forging of claim 18 which has an ultimate tensile strength of at least about 60 ksi.

21. An aluminum alloy forging which comprises by weight about 0.2-5% Li, 0.2-5% Cu, 0-6% Mg, 0-12% Zn, 0-2% Mn, 0-1.0% Zr, up to about 0.5% Fe, 0-0.2% Ti, up to about 0.5% Si and balance Al, said forging having an improved strength level from having been: solution heat treated; quenched; deformed by about 2% or more at one or more elevated temperatures below about 575° F. without preaging; and aged for at least about 2 hours at one or more temperatures between about 250° F. and 400° F.

22. The forging of claim 21 which has been deformed by up to about 50% total deformation using a strain rate of about 0.1-1.5 $sec^{-1}$.

23. The method of claim 1, wherein said method proceeds without stress relieval prior to said deforming step (c).

* * * * *

UNITED STATES PATENT AND TRADEMARK OFFICE

CERTIFICATE OF CORRECTION

PATENT NO. : 5,194,102

DATED : March 16, 1993

INVENTOR(S) : Rebecca K. Wyss

It is certified that error appears in the above-indentified patent and that said Letters Patent is hereby corrected as shown below:

Column 2, line 40, "alloys" should be --products--.

Column 5, line 66, "past" should be --post--.

Claim 1, column 10, line 46, "above said" should read --above about--.

Claim 10, column 11, line 7, "imparting T8-type strength levels to" should read --improving the strength of--.

Claim 10, column 11, line 16, after "400°F." the following should be inserted: --, said method proceeding without preaging prior to deforming step (b).--

Claim 18, column 12, line 12, after "Mg, up to about" the following should be inserted: --0.10% Zn, about 0.02-0.10% Ti, about 0.05-0.15% V, about--.

Signed and Sealed this

Twelfth Day of April, 1994

Bruce Lehman

BRUCE LEHMAN

*Commissioner of Patents and Trademarks*

*Attest:*

*Attesting Officer*